US007985525B2

(12) United States Patent
Ikuta et al.

(10) Patent No.: US 7,985,525 B2
(45) Date of Patent: Jul. 26, 2011

(54) METHOD FOR PRODUCING DEVELOPING AGENT

(75) Inventors: Masahiro Ikuta, Mishima (JP); Takayasu Aoki, Mishima (JP); Takashi Urabe, Sunto-gun (JP); Tsuyoshi Ito, Izunokuni (JP); Motonari Udo, Mishima (JP); Satoshi Araki, Izunokuni (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 748 days.

(21) Appl. No.: 12/103,812

(22) Filed: Apr. 16, 2008

(65) Prior Publication Data

US 2008/0261144 A1 Oct. 23, 2008

Related U.S. Application Data

(60) Provisional application No. 60/912,200, filed on Apr. 17, 2007.

(51) Int. Cl.
*G03G 5/00* (2006.01)

(52) U.S. Cl. ..... 430/137.14

(58) Field of Classification Search ..... 430/137.14
See application file for complete search history.

(56) References Cited

FOREIGN PATENT DOCUMENTS

| | | |
|---|---|---|
| JP | 63-282752 | 11/1988 |
| JP | 06-250439 | 9/1994 |
| JP | 09-311502 | 12/1997 |
| JP | 10-301333 | 11/1998 |

*Primary Examiner* — Mark A Chapman
(74) *Attorney, Agent, or Firm* — Turocy & Watson, LLP

(57) ABSTRACT

A method for producing a developing agent, includes preparing a dispersion of particles containing a binder resin and a coloring agent and forming toner particles by aggregating and fusing the particles, in which the number of coarse particles having a particle size of 0.6 μm or larger after the solid concentration of the dispersion of particles is adjusted to 1 ppm is less than 3,000 per μL.

16 Claims, 1 Drawing Sheet

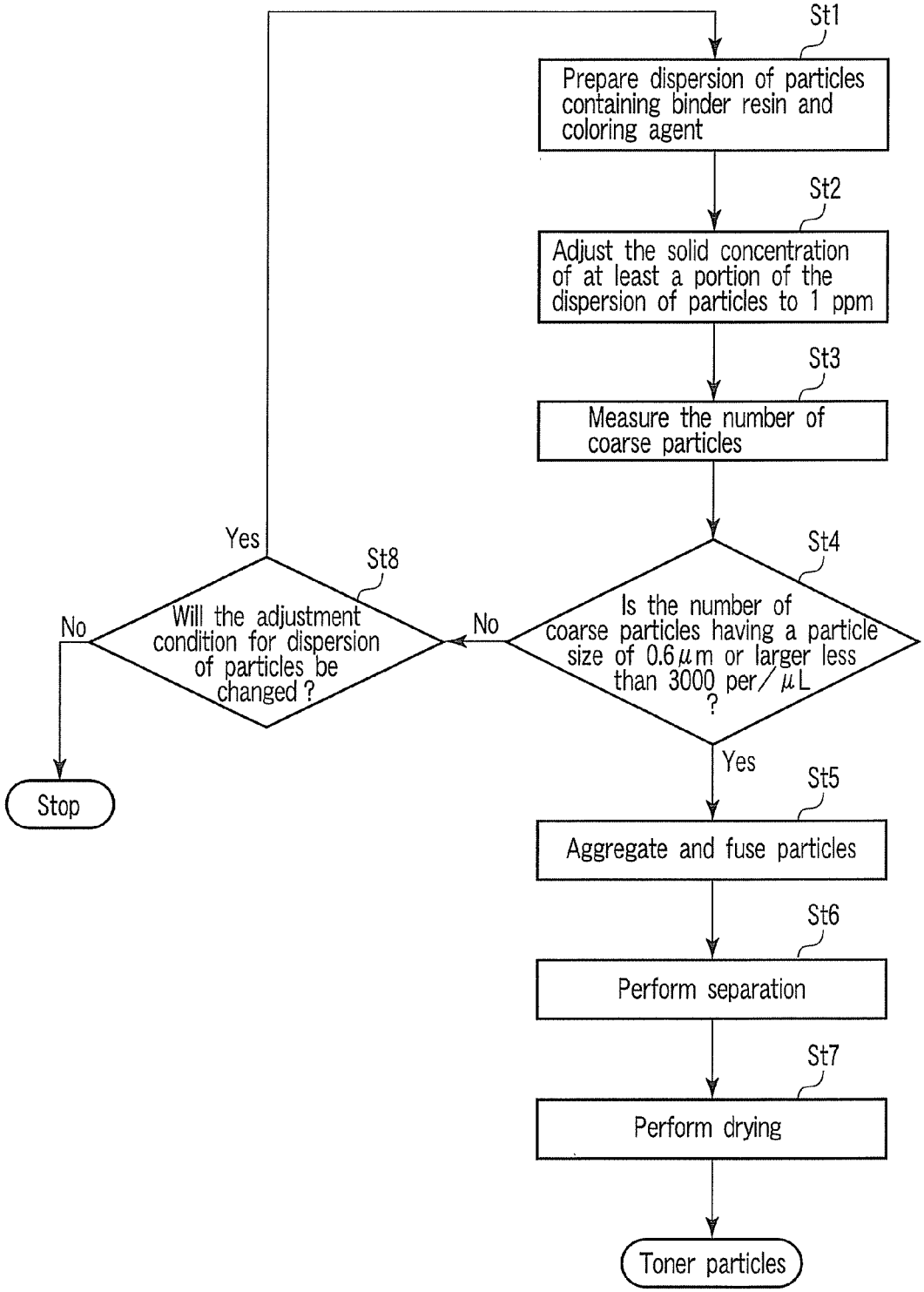
FIGURE

METHOD FOR PRODUCING DEVELOPING AGENT

CROSS-REFERENCE TO RELATED APPLICATIONS

This application claims the benefit of U.S. Provisional Application No. 60/912,200, filed Apr. 17, 2007.

BACKGROUND OF THE INVENTION

1. Field of the Invention

The present invention relates to a method for producing a developing agent for developing an electrostatic image or a magnetic latent image in electrophotography, an electrostatic printing method, a magnetic recording method or the like, and particularly relates to a technique for obtaining toner particles by aggregating particles of developing agent materials.

2. Description of the Related Art

In the past, as a method for producing a toner in which the shape and surface composition of toner particles are intentionally controlled, for example, as disclosed in JP-A-63-282752, JP-A-6-250439 and JP-A-9-311502, an aggregation method in which particles containing a binder resin and a coloring agent are aggregated and fused has been proposed, and in a step of preparing a dispersion of particles containing a binder resin and a coloring agent, a method for producing particles by a polymerization method such as emulsion polymerization or suspension polymerization, a phase inversion emulsification method using an organic solvent or applying a mechanical shearing force, or the like can be employed.

When toner particles are produced by aggregating and fusing particles of toner materials, evaluation of a dispersion prior to aggregation was carried out by measuring particle size distribution of a resulting toner using a laser scattering/diffraction type particle size analyzer or a centrifugal sedimentation type particle size analyzer, and regulating the uniformity of particle size distribution.

However, according to this method, although it is possible to confirm the distribution of particles having a small particle size which occupy the most part in the dispersion, it is difficult to measure coarse particles, which do not exist so much, and it is impossible to quantitatively measure the number of coarse particles. When a large amount of coarse particles exist, particles composed of only a non-colored resin exist, and tinting of a toner is not sufficient, resulting in problems such as liberation of a coloring agent due to non-formation of aggregated particles together with resin particles, deterioration of charge properties due to exposure of a coloring agent on the toner surface and deterioration of OHP transmittance of toner due to the coarse particles as disclosed in JP-A-10-301333. Also, a releasing agent is exposed on the surface of toner particles and thus the fixability of toner is deteriorated, resulting in a problem that the OHP transmittance is reduced due to irregular reflection.

BRIEF SUMMARY OF THE INVENTION

An object of the present invention is to provide a method for producing a developing agent capable of forming a color image with good colorability and transparency.

The method for producing a developing agent of the invention includes the steps of:

preparing a dispersion of particles containing a binder resin and a coloring agent; and forming toner particles by aggregating and fusing the particles, wherein the number of coarse particles having a particle size of 0.6 μm or larger after the solid concentration of the dispersion of particles is adjusted to 1 ppm is less than 3,000 per μL.

According to the invention, a color image with high OHP transmittance can be formed by the method for obtaining toner particles by aggregating and fusing particles of developing agent materials.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawing, which is incorporated in and constitutes a part of the specification, illustrates embodiments of the invention, and together with the general description given above and the detailed description of the embodiments given below, serves to explain the principles of the invention.

The single FIGURE is a flow diagram for illustrating one example of a method for producing a developing agent of the invention.

DETAILED DESCRIPTION OF THE INVENTION

A method for producing a developing agent of the invention includes the steps of: preparing a dispersion of particles containing a binder resin and a coloring agent; and forming toner particles by aggregating and fusing the particles, wherein the number of coarse particles having a particle size of 0.6 μm or larger after the solid concentration of the dispersion of particles is adjusted to 1 ppm is less than 3,000 per μL.

In FIGURE, a flow diagram for illustrating one example of the method for producing a developing agent of the invention is shown.

As shown in the drawing, first, a dispersion of particles containing a binder resin and a coloring agent is prepared (St 1).

In the step of preparing a dispersion of particles containing a binder resin and a coloring agent, for example, a method in which a material containing a binder resin and a coloring agent is melted, kneaded and pulverized, and then, the pulverized material is subjected to a mechanical shearing device or phase inversion emulsification using a solvent, thereby obtaining a dispersion of particles, or a method in which a binder resin is produced by a polymerization method such as emulsion polymerization or suspension polymerization, and mixed with a separately produced coloring agent dispersion, thereby obtaining particles, or the like is employed.

Subsequently, the solid concentration of at least a portion of the dispersion of particles is adjusted to 1 ppm (St 2).

Thereafter, the number of coarse particles having a volume average particle size of 0.6 μm or larger in the dispersion of particles in which the solid concentration has been adjusted to 1 ppm is measured (St 3).

The number of coarse particles having a particle size of 0.6 μm or larger can be measured by, for example, Multisizer 3 manufactured by Beckman Coulter Inc. using an aperture with a diameter of 20 μm.

It is determined as to whether the number of coarse particles having a particle size of 0.6 μm or larger is 3,000 per μL or more or less than that based on the measurement result (St 4).

In the case where the number of coarse particles having a particle size of 0.6 μm or larger is less than 3,000 per μL, the particles are aggregated and fused, thereby obtaining fused particles (St 5).

Aggregation and fusion can be controlled such that the resulting fused particles have a volume average particle size of, for example, 3 μm to 10 μm.

On the other hand, in the case where the number of coarse particles having a particle size of 0.6 μm or larger is 3,000 per μL or more, the adjustment condition for the dispersion of coarse particles is changed and the preparation of dispersion of particles is performed again (St 1) or stopped.

As the method for adjusting the number of coarse particles having a particle size of 0.6 μm or larger to less than 3,000 per μL, a mechanical shearing method can be exemplified. For example, in the mechanical shearing method, the above adjustment can be carried out at a treatment temperature which is higher by 30° C. than the glass transition temperature Tg of a binder resin. Further, in a phase inversion emulsification method, the adjustment can be carried out by controlling the feeding rate of water or by adding a surfactant material in an amount of 1.0% or more relative to the solids. Further, the condition for adjusting the number of coarse particles having a particle size of 0.6 μm or larger to less than 3,000 per μL varies depending on the binder resin employed. For example, in the case where a polyester resin is used, the adjustment can be carried out by adding a neutralizing agent in an amount of 0.4 equivalent or more based on the carboxyl group calculated from the acid value of the polyester resin.

The aggregated and fused particles are separated from a dispersion medium using, for example, a centrifuge or the like (St 6). At this time, by adding, for example, water or the like, washing of particles can be carried out.

The separated aggregated and fused particles are dried, thereby obtaining toner particles (St 7).

With respect to the materials to be used in the method according to the invention, all of known materials can be used as toner materials such as a resin, a coloring agent and a releasing agent.

Examples of the binder resin which is used in the invention include styrene-based resins such as polystyrene, styrene/butadiene copolymers and styrene/acrylic copolymers; ethylene-based resins such as polyethylene, polyethylene/vinyl acetate copolymers, polyethylene/norbornene copolymers and polyethylene/vinyl alcohol copolymers; polyester resins; acrylic resins; phenol-based resins; epoxy-based resins; allyl phthalate-based resins; polyamide-based resins; and maleic acid-based resins. These resins may be used singly or in combination of two or more kinds thereof.

As the binder resin, preferably a binder resin having an acid value of 1 or more can be used.

Examples of the coloring agent which is used in the invention include carbon black and organic or inorganic pigments or dyes. Examples of the carbon black include acetylene black, furnace black, thermal black, channel black, Ketjen black and the like. Also, examples of yellow pigments include C.I. Pigment Yellow 1, 2, 3, 4, 5, 6, 7, 10, 11, 12, 13, 14, 15, 16, 17, 23, 65, 73, 74, 81, 83, 93, 95, 97, 98, 109, 117, 120, 137, 138, 139, 147, 151, 154, 167, 173, 180, 181, 183 and 185, C.I. Vat Yellow 1, 3 and 20, and the like. These can be used singly or in admixture. Also, examples of magenta pigments include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 146, 150, 163, 184, 185, 202, 206, 207, 209 and 238, C.I. Pigment Violet 19, C.I. Vat Red 1, 2, 10, 13, 15, 23, 29 and 35, and the like. These can be used singly or in admixture. Also, examples of cyan pigments include C.I. Pigment Blue 2, 3, 15, 16 and 17, C.I. Vat Blue 6, C.I., Acid Blue 45 and the like. These can be used singly or in admixture.

In the invention, a releasing agent can be used. Examples of the releasing agent include aliphatic hydrocarbon-based waxes such as low molecular weight polyethylene, low molecular weight polypropylene, polyolefin copolymers, polyolefin waxes, microcrystalline waxes, paraffin waxes and Fischer-Tropsch waxes; oxides of an aliphatic hydrocarbon-based wax such as polyethylene oxide waxes or block copolymers thereof; plant waxes such as candelilla wax, carnauba wax, Japan wax, jojoba wax and rice wax; animal waxes such as bees wax, lanolin and whale wax; mineral waxes such as ozokerite, ceresin and petrolactam; waxes containing, as a main component, a fatty acid ester such as montanic acid ester wax and castor wax; and materials obtained by deoxidization of a part or the whole of a fatty acid ester such as deoxidized carnauba wax. Further, saturated linear fatty acids such as palmitic acid, stearic acid, montanic acid and long chain alkylcarboxylic acids having a longer chain alkyl group; unsaturated fatty acids such as brassidic acid, eleostearic acid and parinaric acid; saturated alcohols such as stearyl alcohol, eicosyl alcohol, behenyl alcohol, carnaubyl alcohol, ceryl alcohol, melissyl alcohol and long chain alkyl alcohols having a longer chain alkyl group; polyhydric alcohols such as sorbitol; fatty acid amides such as linoleic acid amide, oleic acid amide and lauric acid amide; saturated fatty acid bisamides such as methylenebisstearic acid amide, ethylenebiscaprylic acid amide, ethylenebislauric acid amide and hexamethylenebisstearic acid amide; unsaturated fatty acid amides such as ethylenebisoleic acid amide, hexamethylenebisoleic acid amide, N,N'-dioleyladipic acid amide and N,N'-dioleylsebaccic acid amide; aromatic bisamides such as m-xylenebisstearic acid amide and N,N'-distearylisophthalic acid amide; fatty acid metal salts (generally called metallic soaps) such as calcium stearate, calcium laurate, zinc stearate and magnesium stearate; waxes obtained by grafting of a vinyl-based monomer such as styrene or acrylic acid on an aliphatic hydrocarbon-based wax; partially esterified products of a fatty acid and a polyhydric alcohol such as behenic acid monoglyceride; and methyl ester compounds having a hydroxyl group obtained by hydrogenation of a vegetable fat and oil can be exemplified.

The releasing agent can be used as a releasing agent dispersion which can be prepared by mixing it with water and, for example, a surfactant such as an anionic surfactant.

It is preferred that the number of releasing agent coarse particles having a particle size of 0.6 μm or larger in this releasing agent dispersion is reduced to less than 3,000 per μL. This can prevent the releasing agent from being exposed on the surface of toner particles, and provides a tendency to achieve good fixability of toner and high OHP transmittance.

Examples of the surfactant which can be used in the invention include anionic surfactants such as sulfate-type surfactants, sulfonate-type surfactants, phosphate-type surfactants and soap-type surfactants; cationic surfactants such as amine salt-type surfactants and quaternary ammonium salt-type surfactants; and nonionic surfactants such as polyethylene glycol-type surfactants, alkylphenol ethylene oxide adduct-type surfactants and polyhydric alcohol-type surfactants.

As the neutralizing agent which can be used in the invention, an inorganic base or an amine compound can be used.

Examples of the inorganic base include sodium hydroxide, potassium hydroxide and the like. Examples of the amine compound include dimethylamine, trimethylamine, monoethylamine, diethylamine, triethylamine, propylamine, isopropylamine, dipropylamine, butylamine, isobutylamine, sec-butylamine, monoethanolamine, diethanolamine, triethanolamine, triisopropanolamine, isopropanolamine, dimethylethanolamine, diethylethanolamine, N-butyldiethanolamine, N,N-dimethyl-1,3-diaminopropane, N,N-diethyl-1,3-diaminopropane and the like.

Examples of the mechanical shearing device which is used in the invention include medium-free stirrers such as ULTRA TURRAX (manufactured by IKA Japan K.K.), T.K. AUTO HOMO MIXER (manufactured by PRIMIX Corporation), T.K. PIPELINE HOMO MIXER (manufactured by PRIMIX Corporation), T.K. FILMICS (manufactured by PRIMIX Corporation), CLEAR MIX (manufactured by MTECHNIQUE Co., Ltd.), CLEAR SS5 (manufactured by MTECHNIQUE Co., Ltd.), CAVITRON (manufactured by EUROTEC, Ltd.) and FINE FLOW MILL (manufactured by Pacific Machinery & Engineering Co., Ltd.); medium stirrers such as VISCO MILL (manufactured by Aimex Co., Ltd.), APEX MILL (manufactured by Kotobuki Industries Co., Ltd.), STAR MILL (manufactured by Ashizawa Finetech Ltd.), DCP SUPERFLOW (manufactured by Nippon Eirich Co., Ltd.), MP MILL (manufactured by Inoue Mfg., Inc.), SPIKE MILL (manufactured by Inoue Mfg., Inc.), MIGHTY MILL (manufactured by Inoue Mfg., Inc.) and SC MILL (manufactured by Mitsui Mining Co., Ltd.), and the like, and high pressure impact type dispersing devices such as Altimizer (manufactured by Sugino Machine K.K.), Nanomizer (manufactured by Yoshida Kikai Co., Ltd.) and NANO3000 (manufactured by BeRyu Co., Ltd.).

As the organic solvent for dissolving a binder resin which is used in the invention, n-butanol, isopropyl alcohol, diacetone alcohol, 2-ethylhexanol, methyl ethyl ketone, acetonitrile, dimethylacetoamide, dimethylformamide, N-methylpyrrolidone, tetrahydrofuran, 1,4-dioxane, 1,3-dioxane, 1,3-oxolane, methyl cellosolve, ethyl cellosolve, butyl cellosolve, ethyl carbitol, butyl carbitol, propylene glycol monopropyl ether, propylene glycol monobutyl ether, toluene, xylene or the like can be used.

EXAMPLES

Hereinafter, the present invention will be described specifically with reference to Examples.

Preparation of Releasing Agent Particle Dispersion 100 parts by weight of paraffin wax (melting point: 85° C., manufactured by Toakasei Co., Ltd.), 10 parts by weight of an anionic surfactant (manufactured by Kao Corporation) and 390 parts by weight of ion exchanged water were dispersed using a homogenizer (manufactured by IKA Japan K.K.) while heating to about 90° C. Thereafter, by using a wet-type high-pressure emulsifying machine, a releasing agent particle dispersion in which the particles had a volume average particle size of 102 nm was produced.

The resulting releasing agent particle dispersion was diluted such that the solid concentration thereof became 1 ppm. Then, the number of coarse particles having a particle size of 0.6 μm or larger was measured by Multisizer 3 manufactured by Beckman Coulter Inc. using an aperture with a diameter of 20 μm and found to be 138 per μL.

Example 1

95 parts by weight of a polyester resin as a binder resin and 5 parts by weight of a copper phthalocyanine pigment as a coloring agent were mixed and then melted and kneaded by a twin-screw kneader set up at a temperature of 120° C., thereby obtaining a kneaded material.

The resulting kneaded material was coarsely pulverized into a volume average particle size of 1.2 mm by a hammer mill manufactured by Nara Machinery Co., Ltd., thereby obtaining coarse particles.

40 parts by weight of the resulting coarse particles, 5 parts by weight of sodium dodecylbenzenesulfonate as an anionic surfactant, and 55 parts by weight of ion exchanged water were placed in CLEAR MIX, and the resulting dispersion was heated to 120° C. Then, the dispersion was mechanically stirred for 30 minutes by setting the rotation speed of the CLEAR MIX to 6,500 rpm, followed by cooling to room temperature, thereby preparing a particle dispersion.

The resulting particle dispersion was diluted such that the solid concentration thereof became 1 ppm. Then, the number of coarse particles having a particle size of 0.6 μm or larger was measured by Multisizer 3 manufactured by Beckman Coulter Inc. using an aperture with a diameter of 20 μm and found to be 1,498 per μL.

Thereafter, 17 parts by weight of the resulting particle dispersion, 3 parts by weight of the above releasing agent and 80 parts by weight of ion exchanged water were mixed, and 2 parts by weight of magnesium sulfate was added thereto. Then, the temperature of the mixture was gradually raised to 70° C. to aggregate the particles, thereby obtaining aggregated particles.

In order to maintain the volume average particle size of the above aggregated particles, 3 parts by weight of sodium dodecylbenzenesulfonate was added as a dispersing agent to the resulting aggregated particles, and the temperature of the mixture was raised to 95° C. to control the shape, and the mixture was left for 2 hours.

After cooling, with respect to the solids of the resulting dispersion, centrifugation using a centrifuge, removal of a supernatant and washing with ion exchanged water were repeatedly carried out, and washing was carried out until the supernatant had a conductivity of 50 μS/cm. Then, drying was carried out using a vacuum dryer until the water content was reduced to 0.3% by weight, thereby obtaining toner particles.

After drying, 2 parts by weight of hydrophobic silica and 0.5 part by weight of titanium oxide were attached as additives to the surface of the toner particles, thereby obtaining a desired electrophotographic toner.

The volume average particle size of the resulting electrophotographic toner was measured by Multisizer 2 manufactured by Beckman Coulter Inc. and found to be 5.04 μm.

The electrophotographic toner was placed in a multifunction machine e-STUDIO 281c manufactured by Toshiba Tec Corporation, which had been modified for evaluation, and the OHP transmittance was evaluated. The OHP transmittance was not lower than 80%, and a high transmittance could be achieved.

Incidentally, the OHP transmittance was evaluated using a spectrophotometer, UV-3101PC (manufactured by Shimadzu Corporation).

Example 2

By using a mixture containing 95 parts by weight of a polyester resin as a binder resin and 5 parts by weight of a copper phthalocyanine pigment as a coloring agent, and uniformly dispersing the mixture with a Henschel mixer manufactured by Mitsui Mining Co., Ltd., thereby obtaining coarse particles having a volume average particle size of 0.8 mm.

40 parts by weight of the resulting coarse particles, 5 parts by weight of sodium dodecylbenzenesulfonate as an anionic surfactant, and 55 parts by weight of ion exchanged water were placed in CLEAR MIX, and the resulting dispersion was heated to 120° C. Then, the dispersion was mechanically stirred for 30 minutes by setting the rotation speed of the CLEAR MIX to 6,500 rpm, followed by cooling to room temperature, thereby preparing a particle dispersion.

The resulting particle dispersion was diluted such that the solid concentration thereof became 1 ppm. Then, the number of coarse particles having a particle size of 0.6 μm or larger was measured by Multisizer 3 manufactured by Beckman Coulter Inc. using an aperture with a diameter of 20 μm and found to be 2,459 per μL.

Then, 17 parts by weight of the resulting particle dispersion, 3 parts by weight of the above releasing agent and 80 parts by weight of ion exchanged water were mixed, and 2 parts by weight of aluminum sulfate was added thereto. Then, the temperature of the mixture was gradually raised to 55° C. to aggregate the particles, thereby obtaining aggregated particles.

In order to maintain the volume average particle size of the above aggregated particles, 5 parts by weight of sodium dodecylbenzenesulfonate was added as a dispersing agent to the resulting aggregated particles, and the temperature of the mixture was raised to 95° C. to control the shape, and the mixture was left for 2 hours.

After cooling, the resulting dispersion was washed in the same manner as in Example 1 using a centrifuge, and drying was carried out using a vacuum dryer until the water content was reduced to 0.3% by weight, thereby obtaining toner particles.

After drying, 2 parts by weight of hydrophobic silica and 0.5 part by weight of titanium oxide were attached as additives to the surface of the toner particles, thereby obtaining a desired electrophotographic toner.

The volume average particle size of the resulting electrophotographic toner was measured by Multisizer 2 manufactured by Beckman Coulter Inc. and found to be 4.89 μm.

The electrophotographic toner was placed in a multifunction machine e-STUDIO 281c manufactured by Toshiba Tec Corporation, which had been modified for evaluation, and the OHP transmittance was evaluated. The OHP transmittance was not lower than 80%, and a high transmittance could be achieved.

Example 3

95 parts by weight of a polyester resin as a binder resin and 5 parts by weight of a naphthol azo pigment as a coloring agent were mixed and kneaded. Then, the resulting kneaded material was coarsely pulverized into a volume average particle size of 1.2 mm, thereby obtaining coarse particles.

40 parts by weight of the resulting coarse particles, 5 parts by weight of sodium dodecylbenzenesulfonate as an anionic surfactant, and 55 parts by weight of ion exchanged water were placed in CLEAR MIX, and the resulting dispersion was heated to 130° C. Then, the dispersion was mechanically stirred for 30 minutes by setting the rotation speed of the CLEAR MIX to 10,000 rpm, followed by cooling to room temperature, thereby preparing a particle dispersion.

The resulting particle dispersion was diluted such that the solid concentration thereof became 1 ppm. Then, the number of coarse particles having a particle size of 0.6 μm or larger was measured by Multisizer 3 manufactured by Beckman Coulter Inc. using an aperture with a diameter of 20 μm and found to be 2,863 per μL.

Then, 17 parts by weight of the resulting particle dispersion, 3 parts by weight of the above releasing agent and 80 parts by weight of ion exchanged water were mixed, and 2 parts by weight of aluminum sulfate was added thereto. Then, the temperature of the mixture was gradually raised to 58° C. to aggregate the particles, thereby obtaining aggregated particles.

In order to maintain the volume average particle size of the above aggregated particles, 5 parts by weight of sodium dodecylbenzenesulfonate was added as a dispersing agent to the resulting aggregated particles, and the temperature of the mixture was raised to 95° C. to control the shape, and the mixture was left for 2 hours.

After cooling, the resulting dispersion was washed in the same manner as in Example 1 using a centrifuge, and drying was carried out using a vacuum dryer until the water content was reduced to 0.3% by weight, thereby obtaining toner particles.

After drying, 2 parts by weight of hydrophobic silica and 0.5 part by weight of titanium oxide were attached as additives to the surface of the toner particles, thereby obtaining a desired electrophotographic toner.

The volume average particle size of the resulting electrophotographic toner was measured by Multisizer 2 manufactured by Beckman Coulter Inc. and found to be 5.53 μm.

The electrophotographic toner was placed in a multifunction machine e-STUDIO 281c manufactured by Toshiba Tec Corporation, which had been modified for evaluation, and the OHP transmittance was evaluated. The OHP transmittance was not lower than 80%, and a high transmittance could be achieved.

Example 4

40 parts by weight of a polyester resin as a binder resin, 5 parts by weight of sodium dodecylbenzenesulfonate as an anionic surfactant, and 55 parts by weight of ion exchanged water were placed in CLEAR MIX, and the resulting dispersion was heated to 110° C. Then, the dispersion was mechanically stirred for 30 minutes by setting the rotation speed of the CLEAR MIX to 6,000 rpm, followed by cooling to room temperature, thereby preparing a binder resin dispersion.

20 parts by weight of a copper phthalocyanine pigment as a coloring agent, 2 parts by weight of sodium dodecylbenzenesulfonate as an anionic surfactant, and 78 parts by weight of ion exchanged water were preliminarily dispersed using a homogenizer manufactured by IKA Japan K.K., and then dispersed using Nanomizer manufactured by Yoshida Kikai Co., Ltd., thereby preparing a coloring agent dispersion.

15 parts by weight of the binder resin dispersion, 1.5 parts by weight of the coloring agent dispersion, 1.5 parts by weight of a releasing agent, and 78 parts by weight of ion exchanged water were mixed, thereby preparing a particle dispersion. The resulting particle dispersion was diluted such that the solid concentration thereof became 1 ppm. Then, the number of coarse particles having a particle size of 0.6 μm or larger was measured by Multisizer 3 manufactured by Beckman Coulter Inc. using an aperture with a diameter of 20 μm and found to be 2,375 per μL.

Then, to the above mixture, 2 parts by weight of magnesium sulfate was added, and the temperature of the mixture was gradually raised to 72° C. to aggregate the particles, thereby obtaining aggregated particles.

In order to maintain the volume average particle size of the above aggregated particles, 3 parts by weight of sodium dodecylbenzenesulfonate was added as a dispersing agent to the resulting aggregated particles, and the temperature of the mixture was raised to 90° C. to control the shape, and the mixture was left for 3 hours.

After cooling, the resulting dispersion was washed in the same manner as in Example 1 using a centrifuge, and drying was carried out using a vacuum dryer until the water content was reduced to 0.3% by weight, thereby obtaining toner particles.

After drying, 2 parts by weight of hydrophobic silica and 0.5 part by weight of titanium oxide were attached as additives to the surface of the toner particles, thereby obtaining a desired electrophotographic toner.

The volume average particle size of the resulting electrophotographic toner was measured by Multisizer 2 manufactured by Beckman Coulter Inc. and found to be 5.26 μm.

The electrophotographic toner was placed in a multifunction machine e-STUDIO 281c manufactured by Toshiba Tec Corporation, which had been modified for evaluation, and the OHP transmittance was evaluated. The OHP transmittance was not lower than 80%, and a high transmittance could be achieved.

Example 5

90 parts by weight of a polyester resin as a binder resin, 5 parts by weight of a copper phthalocyanine pigment as a coloring agent, and 5 parts by weight of an ester wax as a releasing agent were mixed and then melted and kneaded by a twin-screw kneader set up at a temperature of 120° C., thereby obtaining a kneaded material.

The resulting kneaded material was coarsely pulverized into a volume average particle size of 1.2 mm by a hammer mill manufactured by Nara Machinery Co., Ltd., thereby obtaining coarse particles.

The resulting coarse particles were moderately pulverized into a volume average particle size of 0.05 mm by a bantam mill manufactured by Hosokawa Micron Corporation, thereby obtaining moderately pulverized particles.

40 parts by weight of the moderately pulverized particles, 4 parts by weight of sodium dodecylbenzenesulfonate as an anionic surfactant, 1 part by weight of triethylamine as an amine compound, and 55 parts by weight of ion exchanged water were treated at 160 MPa and 150° C. by NANO3000, thereby preparing a particle dispersion.

The resulting particle dispersion was diluted such that the solid concentration thereof became 1 ppm. Then, the number of coarse particles having a particle size of 0.6 μm or larger was measured by Multisizer 3 manufactured by Beckman Coulter Inc. using an aperture with a diameter of 20 μm and found to be 1,028 per μL.

Then, 20 parts by weight of the resulting particle dispersion and 80 parts by weight of ion exchanged water were mixed, and 2 parts by weight of aluminum sulfate was added thereto, and the temperature of the mixture was gradually raised to 53° C. to aggregate the particles, thereby obtaining aggregated particles.

In order to maintain the volume average particle size of the above aggregated particles, 7 parts by weight of sodium dodecylbenzenesulfonate was added as a dispersing agent to the resulting aggregated particles, and the temperature of the mixture was raised to 98° C. to control the shape, and the mixture was left for 2 hours.

After cooling, the resulting dispersion was washed in the same manner as in Example 1 using a centrifuge, and drying was carried out using a vacuum dryer until the water content was reduced to 0.3% by weight, thereby obtaining toner particles.

After drying, 2 parts by weight of hydrophobic silica and 0.5 part by weight of titanium oxide were attached as additives to the surface of the toner particles, thereby obtaining a desired electrophotographic toner.

The volume average particle size of the resulting electrophotographic toner was measured by Multisizer 2 manufactured by Beckman Coulter Inc. and found to be 4.92 μm.

The electrophotographic toner was placed in a multifunction machine e-STUDIO 281c manufactured by Toshiba Tec Corporation, which had been modified for evaluation, and the OHP transmittance was evaluated. The OHP transmittance was not lower than 80%, and a high transmittance could be achieved.

Example 6

To 100 parts by weight of a polyester resin as a binder resin, 200 parts by weight of methyl ethyl ketone and 5 parts by weight of triethylamine were added and dissolved therein at a temperature of 50° C. At a temperature of 50° C., 400 parts by weight of ion exchanged water containing 10 parts by weight of sodium dodecylbenzenesulfonate as an anionic surfactant was added thereto, thereby obtaining a binder resin dispersion containing a solvent. The solvent was removed, thereby preparing a binder resin dispersion.

20 parts by weight of a copper phthalocyanine pigment as a coloring agent, 2 parts by weight of sodium dodecylbenzenesulfonate as an anionic surfactant, and 78 parts by weight of ion exchanged water were preliminarily dispersed using a homogenizer manufactured by IKA Japan K.K., and then dispersed using Nanomizer manufactured by Yoshida Kikai Co., Ltd., thereby preparing a coloring agent dispersion.

30 parts by weight of the binder resin dispersion, 1.5 parts by weight of the coloring agent dispersion, 1.5 parts by weight of a releasing agent, and 67 parts by weight of ion exchanged water were mixed, thereby preparing a particle dispersion.

The resulting particle dispersion was diluted such that the solid concentration thereof became 1 ppm. Then, the number of coarse particles having a particle size of 0.6 μm or larger was measured by Multisizer 3 manufactured by Beckman Coulter Inc. using an aperture with a diameter of 20 μm and found to be 1,653 per μL.

Then, 17 parts by weight of the resulting particle dispersion was mixed with 3 parts by weight of the above releasing agent and 80 parts by weight of ion exchanged water, and 2 parts by weight of magnesium sulfate was added thereto, and the temperature of the mixture was gradually raised to 70° C. to aggregate the particles, thereby obtaining aggregated particles.

In order to maintain the volume average particle size of the above aggregated particles, 3 parts by weight of sodium dodecylbenzenesulfonate was added as a dispersing agent to the resulting aggregated particles, and the temperature of the mixture was raised to 95° C. to control the shape, and the mixture was left for 2 hours.

After cooling, the resulting dispersion was washed in the same manner as in Example 1 using a centrifuge, and drying was carried out using a vacuum dryer until the water content was reduced to 0.3% by weight, thereby obtaining toner particles.

After drying, 2 parts by weight of hydrophobic silica and 0.5 part by weight of titanium oxide were attached as additives to the surface of the toner particles, thereby obtaining a desired electrophotographic toner.

The volume average particle size of the resulting electrophotographic toner was measured by Multisizer 2 manufactured by Beckman Coulter Inc. and found to be 5.15 μm.

The electrophotographic toner was placed in a multifunction machine e-STUDIO 281c manufactured by Toshiba Tec Corporation, which had been modified for evaluation, and the OHP transmittance was evaluated. The OHP transmittance was not lower than 80%, and a high transmittance could be achieved.

Example 7

300 parts by weight of styrene, 36 parts by weight of butyl acrylate, 4.5 parts by weight of acrylic acid, and 13.5 parts by weight of dodecanethiol were mixed, thereby preparing a monomer dispersion. The resulting monomer dispersion was dispersed and emulsified in a solvent obtained by dissolving 2 parts by weight of a nonionic surfactant and 3 parts by weight of an anionic surfactant in 811 parts by weight of ion exchanged water, and the resulting emulsion was sealed with nitrogen gas. Then, the temperature of the emulsion was raised to 75° C., and 20 parts by weight of a 10% ammonium persulfate solution was added thereto. After the mixture was stirred at 75° C. for 4 hours, an additional 10 parts by weight of a 10% ammonium persulfate solution was added thereto. Emulsion polymerization was carried out at 75° C. for 7 hours, thereby preparing a binder resin dispersion.

20 parts by weight of a copper phthalocyanine pigment as a coloring agent, 2 parts by weight of sodium dodecylbenzenesulfonate as an anionic surfactant, and 78 parts by weight of ion exchanged water were preliminarily dispersed using a homogenizer manufactured by IKA Japan K.K., and then dispersed using Nanomizer manufactured by Yoshida Kikai Co., Ltd., thereby preparing a coloring agent dispersion.

15 parts by weight of the binder resin dispersion, 1.5 parts by weight of the coloring agent dispersion, 1.5 parts by weight of a releasing agent, and 78 parts by weight of ion exchanged water were mixed, thereby preparing a particle dispersion. The resulting particle dispersion was diluted such that the solid concentration thereof became 1 ppm. Then, the number of coarse particles having a particle size of 0.6 μm or larger was measured by Multisizer 3 manufactured by Beckman Coulter Inc. using an aperture with a diameter of 20 μm and found to be 2,189 per μL.

Then, to the above mixture, 0.5 part by weight of aluminum sulfate was added, and the temperature of the mixture was gradually raised to 60° C. to aggregate the particles, thereby obtaining aggregated particles.

In order to maintain the volume average particle size of the above aggregated particles, 5 parts by weight of sodium dodecylbenzenesulfonate was added as a dispersing agent to the resulting aggregated particles, and the temperature of the mixture was raised to 95° C. to control the shape, and the mixture was left for 3 hours.

After cooling, the resulting dispersion was washed in the same manner as in Example 1 using a centrifuge, and drying was carried out using a vacuum dryer until the water content was reduced to 0.3% by weight, thereby obtaining toner particles.

After drying, 2 parts by weight of hydrophobic silica and 0.5 part by weight of titanium oxide were attached as additives to the surface of the toner particles, thereby obtaining a desired electrophotographic toner.

The volume average particle size of the resulting electrophotographic toner was measured by Multisizer 2 manufactured by Beckman Coulter Inc. and found to be 5.32 μm.

The electrophotographic toner was placed in a multifunction machine e-STUDIO 281c manufactured by Toshiba Tec Corporation, which had been modified for evaluation, and the OHP transmittance was evaluated. The OHP transmittance was not lower than 80%, and a high transmittance could be achieved.

Comparative Example 1

95 parts by weight of a polyester resin as a binder resin and 5 parts by weight of a copper phthalocyanine pigment as a coloring agent were mixed and then melted and kneaded by a twin-screw kneader set up at a temperature of 120° C., thereby obtaining a kneaded material.

The resulting kneaded material was coarsely pulverized into a volume average particle size of 1.2 mm by a hammer mill manufactured by Nara Machinery Co., Ltd., thereby obtaining coarse particles.

40 parts by weight of the resulting coarse particles, 5 parts by weight of sodium dodecylbenzenesulfonate as an anionic surfactant, and 55 parts by weight of ion exchanged water were placed in CLEAR MIX, and the resulting dispersion was heated to 100° C. Then, the dispersion was mechanically stirred for 30 minutes by setting the rotation speed of the CLEAR MIX to 5,000 rpm, followed by cooling to room temperature, thereby preparing a particle dispersion.

The resulting particle dispersion was diluted such that the solid concentration thereof became 1 ppm. Then, the number of coarse particles having a particle size of 0.6 μm or larger was measured by Multisizer 3 manufactured by Beckman Coulter Inc. using an aperture with a diameter of 20 μm and found to be 3,592 per μL.

Then, 17 parts by weight of the resulting particle dispersion, 3 parts by weight of the above releasing agent and 80 parts by weight of ion exchanged water were mixed, and 2 parts by weight of magnesium sulfate was added thereto. Then, the temperature of the mixture was gradually raised to 70° C. to aggregate the particles, thereby obtaining aggregated particles.

In order to maintain the volume average particle size of the above aggregated particles, 3 parts by weight of sodium dodecylbenzenesulfonate was added as a dispersing agent to the resulting aggregated particles, and the temperature of the mixture was raised to 95° C. to control the shape, and the mixture was left for 2 hours.

After cooling, the resulting dispersion was washed in the same manner as in Example 1 using a centrifuge, and drying was carried out using a vacuum dryer until the water content was reduced to 0.3% by weight, thereby obtaining toner particles.

After drying, 2 parts by weight of hydrophobic silica and 0.5 part by weight of titanium oxide were attached as additives to the surface of the toner particles, thereby obtaining a desired electrophotographic toner.

The volume average particle size of the resulting electrophotographic toner was measured by Multisizer 2 manufactured by Beckman Coulter Inc. and found to be 5.78 μm.

The electrophotographic toner was placed in a multifunction machine e-STUDIO 281c manufactured by Toshiba Tec Corporation, which had been modified for evaluation, and the OHP transmittance was evaluated. The OHP transmittance was lower than 80%, and a high transmittance could not be achieved.

Comparative Example 2

40 parts by weight of a polyester resin as a binder resin, 5 parts by weight of sodium dodecylbenzenesulfonate as an anionic surfactant, and 55 parts by weight of ion exchanged water were placed in CLEAR MIX, and the resulting dispersion was heated to 110° C. Then, the dispersion was mechanically stirred for 15 minutes by setting the rotation speed of the CLEAR MIX to 6,000 rpm, followed by cooling to room temperature, thereby preparing a binder resin dispersion.

20 parts by weight of a copper phthalocyanine pigment as a coloring agent, 2 parts by weight of sodium dodecylbenzenesulfonate as an anionic surfactant, and 78 parts by weight of ion exchanged water were preliminarily dispersed using a homogenizer manufactured by IKA Japan K.K., and then dispersed using Nanomizer manufactured by Yoshida Kikai Co., Ltd., thereby preparing a coloring agent dispersion.

15 parts by weight of the binder resin dispersion, 1.5 parts by weight of the coloring agent dispersion, 1.5 parts by weight of a releasing agent, and 78 parts by weight of ion exchanged water were mixed, thereby preparing a particle dispersion. The resulting particle dispersion was diluted such that the solid concentration thereof became 1 ppm. Then, the number of coarse particles having a particle size of 0.6 μm or larger was measured by Multisizer 3 manufactured by Beckman Coulter Inc. using an aperture with a diameter of 20 μm and found to be 3,154 per μL.

Then, to the above mixture, 2 parts by weight of magnesium sulfate was added, and the temperature of the mixture was gradually raised to 70° C. to aggregate the particles, thereby obtaining aggregated particles.

In order to maintain the volume average particle size of the above aggregated particles, 3 parts by weight of sodium dodecylbenzenesulfonate was added as a dispersing agent to the resulting aggregated particles, and the temperature of the mixture was raised to 90° C. to control the shape, and the mixture was left for 3 hours.

After cooling, the resulting dispersion was washed in the same manner as in Example 1 using a centrifuge, and drying was carried out using a vacuum dryer until the water content was reduced to 0.3% by weight, thereby obtaining toner particles.

After drying, 2 parts by weight of hydrophobic silica and 0.5 part by weight of titanium oxide were attached as additives to the surface of the toner particles, thereby obtaining a desired electrophotographic toner.

The volume average particle size of the resulting electrophotographic toner was measured by Multisizer 2 manufactured by Beckman Coulter Inc. and found to be 5.51 μm.

The electrophotographic toner was placed in a multifunction machine e-STUDIO 281c manufactured by Toshiba Tec Corporation, which had been modified for evaluation, and the OHP transmittance was evaluated. The OHP transmittance was lower than 80%, and a high transmittance could not be achieved.

Comparative Example 3

40 parts by weight of a polyester resin as a binder resin, 5 parts by weight of sodium dodecylbenzenesulfonate as an anionic surfactant, and 55 parts by weight of ion exchanged water were placed in CLEAR MIX, and the resulting dispersion was heated to 100° C. Then, the dispersion was mechanically stirred for 15 minutes by setting the rotation speed of the CLEAR MIX to 5,000 rpm, followed by cooling to room temperature, thereby preparing a binder resin dispersion.

20 parts by weight of a copper phthalocyanine pigment as a coloring agent, 2 parts by weight of sodium dodecylbenzenesulfonate as an anionic surfactant, and 78 parts by weight of ion exchanged water were preliminarily dispersed using a homogenizer manufactured by IKA Japan K.K., and then dispersed using Nanomizer manufactured by Yoshida Kikai Co., Ltd., thereby preparing a coloring agent dispersion.

15 parts by weight of the binder resin dispersion, 1.5 parts by weight of the coloring agent dispersion, 1.5 parts by weight of a releasing agent, and 78 parts by weight of ion exchanged water were mixed, thereby preparing a particle dispersion. The resulting particle dispersion was diluted such that the solid concentration thereof became 1 ppm. Then, the number of coarse particles having a particle size of 0.6 μm or larger was measured by Multisizer 3 manufactured by Beckman Coulter Inc. using an aperture with a diameter of 20 μm and found to be 4,019 per μL.

Then, to the above mixture, 2 parts by weight of magnesium sulfate was added, and the temperature of the mixture was gradually raised to 65° C. to aggregate the particles, thereby obtaining aggregated particles.

In order to maintain the volume average particle size of the above aggregated particles, 3 parts by weight of sodium dodecylbenzenesulfonate was added as a dispersing agent to the resulting aggregated particles, and the temperature of the mixture was raised to 90° C. to control the shape, and the mixture was left for 3 hours.

After cooling, the resulting dispersion was washed in the same manner as in Example 1 using a centrifuge, and drying was carried out using a vacuum dryer until the water content was reduced to 0.3% by weight, thereby obtaining toner particles.

After drying, 2 parts by weight of hydrophobic silica and 0.5 part by weight of titanium oxide were attached as additives to the surface of the toner particles, thereby obtaining a desired electrophotographic toner.

The volume average particle size of the resulting electrophotographic toner was measured by Multisizer 2 manufactured by Beckman Coulter Inc. and found to be 5.12 μm.

The electrophotographic toner was placed in a multifunction machine e-STUDIO 281c manufactured by Toshiba Tec Corporation, which had been modified for evaluation, and the OHP transmittance was evaluated. The OHP transmittance was lower than 80%, and a high transmittance could not be achieved.

Comparative Example 4

The same binder resin dispersion as in Example 5 was used.

20 parts by weight of a copper phthalocyanine pigment as a coloring agent, 2 parts by weight of sodium dodecylbenzenesulfonate as an anionic surfactant, and 78 parts by weight of ion exchanged water were preliminarily dispersed using a homogenizer manufactured by IKA Japan K.K., and then dispersed using Nanomizer manufactured by Yoshida Kikai Co., Ltd., thereby preparing a coloring agent dispersion.

15 parts by weight of the binder resin dispersion, 1.5 parts by weight of the coloring agent dispersion, 1.5 parts by weight of a releasing agent, and 78 parts by weight of ion exchanged water were mixed, thereby preparing a particle dispersion. The resulting particle dispersion was diluted such that the solid concentration thereof became 1 ppm. Then, the number of coarse particles having a particle size of 0.6 μm or larger was measured by Multisizer 3 manufactured by Beckman Coulter Inc. using an aperture with a diameter of 20 μm and found to be 3,717 per μL.

Then, to the above mixture, 0.5 part by weight of aluminum sulfate was added, and the temperature of the mixture was gradually raised to 60° C. to aggregate the particles, thereby obtaining aggregated particles.

In order to maintain the volume average particle size of the above aggregated particles, 5 parts by weight of sodium dodecylbenzenesulfonate was added as a dispersing agent to the resulting aggregated particles, and the temperature of the mixture was raised to 95° C. to control the shape, and the mixture was left for 3 hours.

After cooling, the resulting dispersion was washed in the same manner as in Example 1 using a centrifuge, and drying was carried out using a vacuum dryer until the water content was reduced to 0.3% by weight, thereby obtaining toner particles.

After drying, 2 parts by weight of hydrophobic silica and 0.5 part by weight of titanium oxide were attached as additives to the surface of the toner particles, thereby obtaining a desired electrophotographic toner.

The volume average particle size of the resulting electrophotographic toner was measured by Multisizer 2 manufactured by Beckman Coulter Inc. and found to be 5.23 μm.

The electrophotographic toner was placed in a multifunction machine e-STUDIO 281c manufactured by Toshiba Tec Corporation, which had been modified for evaluation, and the OHP transmittance was evaluated. The OHP transmittance was lower than 80%, and a high transmittance could not be achieved.

The obtained results for the above-mentioned Examples and Comparative examples are shown in the following Table 1.

TABLE 1

| | Composition prior to aggregation | Number of coarse particles [per μL] | Average particle size of toner [μm] | OHP transmittance |
|---|---|---|---|---|
| Example 1 | Polyester resin<br>Copper phthalocyanine pigment | 1498 | 5.04 | ○ |
| Example 2 | Polyester resin<br>Copper phthalocyanine pigment | 2459 | 4.89 | ○ |
| Example 3 | Polyester resin<br>Naphthol azo pigment | 2863 | 5.53 | ○ |
| Example 4 | Polyester resin<br>Copper phthalocyanine pigment | 2375 | 5.26 | ○ |
| Example 5 | Polyester resin<br>Copper phthalocyanine pigment | 1028 | 4.92 | ○ |
| Example 6 | Polyester resin<br>Copper phthalocyanine pigment | 1653 | 5.15 | ○ |
| Example 7 | Styrene-acrylic resin<br>Copper phthalocyanine pigment | 2189 | 5.32 | ○ |
| Comparative Example 1 | Polyester resin<br>Copper phthalocyanine pigment | 3598 | 5.78 | X |
| Comparative Example 2 | Polyester resin<br>Copper phthalocyanine pigment | 3154 | 5.51 | X |
| Comparative Example 3 | Polyester resin<br>Copper phthalocyanine pigment | 4019 | 5.12 | X |
| Comparative Example 4 | Styrene-acrylic resin<br>Copper phthalocyanine pigment | 3717 | 5.23 | X |

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for producing a developing agent, comprising:

preparing a dispersion of particles containing a binder resin and a coloring agent; and forming toner particles by aggregating and fusing the particles, wherein the number of coarse particles having a particle size of 0.6 μm or larger after the solid concentration of the dispersion of particles is adjusted to 1 ppm is less than 3,000 per μL.

2. The method for producing a developing agent according to claim 1, wherein the number of coarse particles having a particle size of 0.6 μm or larger is measured by using a Coulter Counter with an aperture diameter of 20 μm.

3. The method for producing a developing agent according to claim 1, wherein the preparing the dispersion of particles includes removing at least a portion of the coarse particles having a particle size of 0.6 μm or larger.

4. The method for producing a developing agent according to claim 1, wherein the dispersion of particles further contains a releasing agent.

5. The method for producing a developing agent according to claim 4, wherein a releasing agent dispersion containing the releasing agent is prepared in advance, the number of releasing agent coarse particles having a particle size of 0.6 μm or larger in the releasing agent dispersion is reduced to less than 3,000 per μL, and the resulting releasing agent dispersion is added to the dispersion of particles.

6. The method for producing a developing agent according to claim 1, wherein in the preparing the dispersion of particles, a binder resin dispersion and a coloring agent dispersion both of which have been prepared in advance are mixed.

7. A method for producing a developing agent, comprising:

preparing a dispersion of particles containing a binder resin and a coloring agent by subjecting a material containing the particles to a mechanical shearing device; and forming toner particles by aggregating and fusing the particles, wherein the number of coarse particles having a particle size of 0.6 μm or larger after the solid concentration of the dispersion of particles is adjusted to 1 ppm is less than 3,000 per μL.

8. The method for producing a developing agent according to claim 7, wherein the number of coarse particles having a particle size of 0.6 μm or larger is measured by using a Coulter Counter with an aperture diameter of 20 μm.

9. The method for producing a developing agent according to claim 7, wherein the preparing the dispersion of particles includes removing at least a portion of the coarse particles having a particle size of 0.6 μm or larger.

10. The method for producing a developing agent according to claim 7, wherein the dispersion of particles further contains a releasing agent.

11. The method for producing a developing agent according to claim 10, wherein a releasing agent dispersion containing the releasing agent is prepared in advance, the number of releasing agent coarse particles having a particle size of 0.6 μm or larger in the releasing agent dispersion is reduced to less than 3,000 per μL, and the resulting releasing agent dispersion is added to the dispersion of particles.

12. A method for producing a developing agent, comprising:

preparing a dispersion of particles obtained by melting and kneading a binder resin and a coloring agent followed by pulverizing the resulting material; and forming toner particles by aggregating and fusing the particles, wherein the number of coarse particles having a particle size of 0.6 μm or larger after the solid concentration of the dispersion of particles is adjusted to 1 ppm is less than 3,000 per μL.

13. The method for producing a developing agent according to claim 12, wherein the number of coarse particles having a particle size of 0.6 μm or larger is measured by using a Coulter Counter with an aperture diameter of 20 μm.

14. The method for producing a developing agent according to claim 12, wherein the preparing the dispersion of particles includes removing at least a portion of the coarse particles having a particle size of 0.6 μm or larger.

15. The method for producing a developing agent according to claim 12, wherein the dispersion of particles further contains a releasing agent.

16. The method for producing a developing agent according to claim 15, wherein a releasing agent dispersion containing the releasing agent is prepared in advance, the number of releasing agent coarse particles having a particle size of 0.6 μm or larger in the releasing agent dispersion is reduced to less than 3,000 per μL, and the resulting releasing agent dispersion is added to the dispersion of particles.

* * * * *